US009372443B2

(12) United States Patent
Sasaki et al.

(10) Patent No.: US 9,372,443 B2
(45) Date of Patent: Jun. 21, 2016

(54) DEVELOPING DEVICE AND IMAGE FORMING APPARATUS INCLUDING SAME

(71) Applicant: KYOCERA Document Solutions Inc., Osaka (JP)

(72) Inventors: Asami Sasaki, Osaka (JP); Masaru Hatano, Osaka (JP); Norio Kubo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/838,359

(22) Filed: Aug. 27, 2015

(65) Prior Publication Data

US 2016/0077464 A1 Mar. 17, 2016

(30) Foreign Application Priority Data

Sep. 16, 2014 (JP) ..... 2014-187477

(51) Int. Cl.

*G03G 21/00* (2006.01)
*G03G 15/08* (2006.01)
*G03G 21/20* (2006.01)

(52) U.S. Cl.

CPC ..... *G03G 15/0896* (2013.01); *G03G 15/0818* (2013.01); *G03G 21/0052* (2013.01); *G03G 21/206* (2013.01)

(58) Field of Classification Search

CPC ..... G03G 15/08; G03G 15/00; G03G 15/06; G03G 15/0813; G03G 15/0865; G03G 15/2053

See application file for complete search history.

(56) References Cited

U.S. PATENT DOCUMENTS 5,175,586 A * 12/1992 Goseki ..... G03G 15/0928 399/270
2013/0108310 A1* 5/2013 Hirakawa ..... G03G 15/0898 399/92
2013/0236213 A1* 9/2013 Yamauchi ..... G03G 5/14708 399/159

FOREIGN PATENT DOCUMENTS

JP 2013-97217 A 5/2013

* cited by examiner

*Primary Examiner* — Walter L Lindsay, Jr.
*Assistant Examiner* — Jessica L Eley
(74) *Attorney, Agent, or Firm* — Stein IP, LLC

(57) ABSTRACT

A developing device includes a developing container, a toner carrier, and a plurality of air outlet ports. The plurality of air outlet ports are formed in such part of a wall of the developing container as faces the toner carrier, along a longitudinal direction of the developing container, the air outlet ports communicating with a duct next to the developing container. The toner carrier includes a coat layer on the outer circumferential surface thereof. The coat layer is formed by dripping the toner carrier into a resin coating liquid with one end in the longitudinal direction thereof first, the one end being a lower end of during the dipping, and then lifting the toner carrier out of the resin coating liquid. The toner carrier is arranged such that the lower end of during the dipping is disposed on an upstream side with respect to an airflow direction in the duct.

7 Claims, 7 Drawing Sheets

DEVELOPING DEVICE AND IMAGE FORMING APPARATUS INCLUDING SAME

INCORPORATION BY REFERENCE

This application is based upon and claims the benefit of priority from the corresponding Japanese Patent Application No. 2014-187477 filed on Sep. 16, 2014, the entire contents of which are incorporated herein by reference.

BACKGROUND

The present disclosure relates to a developing device which supplies toner to an image carrier by using a toner carrier, and also relates to an electrophotographic image forming apparatus including such a developing device.

An electrophotographic image forming apparatus forms an electrostatic latent image by irradiating a circumferential surface of an image carrier (photosensitive drum) with light based on image information read from an original image or image information obtained, by transmission and so on, from an external device such as a computer. The image forming apparatus supplies toner from the developing device to the electrostatic latent image and forms a toner image, and then transfers the toner image onto a sheet. After the transfer processing, fixing processing is performed on the toner image, and then the sheet is ejected out of the image forming apparatus.

In recent years, more and more image forming apparatuses have come to be equipped with a color printing function and capable of high-speed processing. This progress has naturally caused image forming apparatuses to be configured increasingly more intricate, and further, higher-speed processing requires higher-speed rotation of a toner stirring member inside a developing device, and such high-speed rotation causes the developing device to tend to have positive internal pressure, which is higher than the ambient pressure. When toner is supplied to a photosensitive drum from a developing device having positive internal pressure, part of the toner leaks out of the developing device as scattered toner through an opening (a toner supply port) thereof which faces the photosensitive drum, and stains the interior of the image forming apparatus.

In particular, with a developing system that uses a two-component developer containing a magnetic carrier and a toner, and that also uses a magnetic roller (a developer carrier) for carrying the developer and a developing roller (a toner carrier) for carrying only the toner, toner that has not been used in the development is stripped off from the developing roller by a magnetic brush formed on the magnetic roller at a developing roller-magnetic roller opposing portion at which the developing roller and the magnetic roller face each other. This causes the toner to be likely to float in the vicinity of the developing roller-magnetic roller opposing portion, and the floating toner leaks out as scattered toner. Moreover, such floating toner accumulates in the interior of the developing device and forms lumps of toner, which fall down onto the developing roller, disrupting the thin layer of toner formed on the developing roller. This makes defects such as "dropping toner" more likely to occur, in which toner is not supplied to a portion where toner should be adhering on a circumferential surface of the photosensitive drum.

To overcome such defects as described above, some known developing devices prevent leakage of toner floating therein through an opening thereof by forcefully sucking in air into a duct disposed in an upper portion of a developing device through an air outlet port formed in an upper end portion of the developing device disposed to face a toner carrier

SUMMARY

According to one aspect of the present disclosure, a developing device includes a developing container, a toner carrier, and a plurality of air outlet ports. The developing container is configured to hold therein a developer containing a toner. The toner carrier has part of an outer circumferential surface thereof exposed through an opening in the developing container, whereby the toner carrier is arranged so as to face an image carrier, the toner carrier being configured to supply toner to the image carrier. The plurality of air outlet ports are formed in such part of a wall of the developing container as faces the toner carrier, along a longitudinal direction of the developing container, and the plurality of air outlet ports communicate with an interior of a duct disposed next to the developing container. The toner carrier has a coat layer formed on the outer circumferential surface thereof. The coat layer is formed by means of a dipping method of dipping the toner carrier into a resin coating liquid with one end of the toner carrier in the longitudinal direction thereof first, the one end being a lower end of during the dipping, and then lifting the toner carrier out of the resin coating liquid with another end of the toner carrier in the longitudinal direction thereof first. The toner carrier is arranged such that the lower end of during the dipping is disposed on an upstream side with respect to an airflow direction in the duct.

Still other objects and specific advantages of the present disclosure will become apparent from the following descriptions of preferred embodiments.

DETAILED DESCRIPTION

Figure 1:
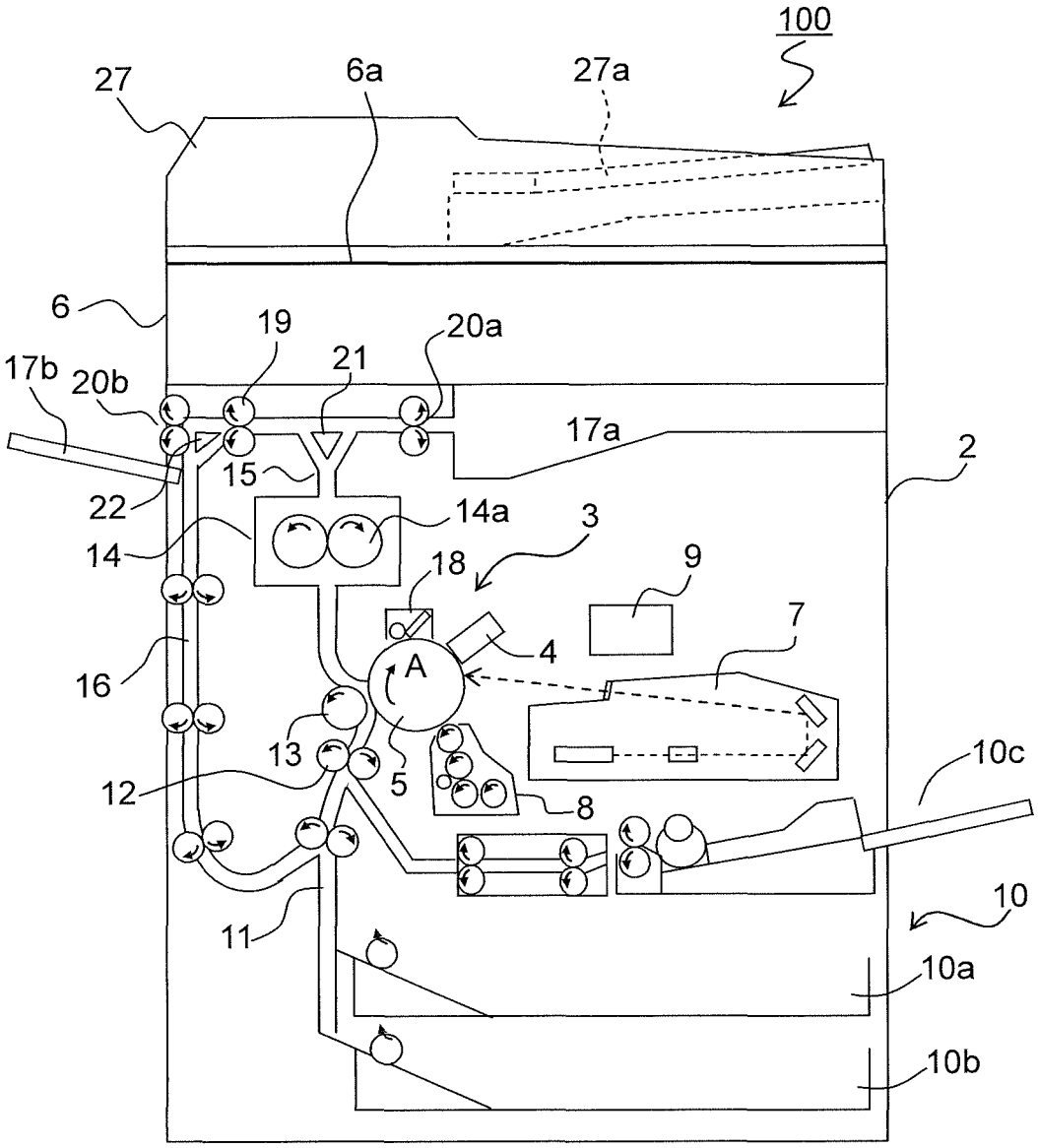
FIG. 1 is a schematic configuration diagram of an image forming apparatus 100 incorporating a developing device 8 of the present disclosure.

Hereinafter, embodiments of the present disclosure will be described with reference to the accompanying drawings. FIG. 1 is a schematic configuration diagram of an image forming apparatus 100 including a developing device 8 according to an embodiment of the present disclosure. In a copying operation performed by the image forming apparatus 100 shown in FIG. 1 (here, a digital multifunction peripheral is shown as an example), image data of a document is read and converted into an image signal at an image reading device 6 which will be described later. On the other hand, at an image forming portion 3 inside a multifunction peripheral main body 2, a photosensitive drum 5 rotating in direction A in the figure is charged uniformly by a charging unit 4, then an electrostatic latent image is formed on the photosensitive drum 5 by a laser beam that is based on the document image data read at the image reading device 6 and that comes from an exposure unit (such as a laser scanning unit) 7, and then the developing device 8 makes toner adhere to the electrostatic latent image, whereby a toner image is formed. The supply of toner to developing device 8 comes from a toner container 9.

Toward the photosensitive drum 5 on which the toner image has been formed in this way, a sheet is transported from a sheet feed mechanism 10 via a sheet transport path 11 and a registration roller pair 12 to the image forming portion 3, where the toner image on the photosensitive drum 5 is transferred onto the sheet by a transfer roller 13 (image transfer portion). Then, the sheet having the toner image transferred thereon is separated from the photosensitive drum 5 and transported to a fixing portion 14 having a fixing roller pair 14*a*, where the toner image is fixed. The sheet that has passed through the fixing portion 14 is sent to a sheet transport path 15 that diverges in a plurality of directions, then the transport direction of the sheet is sorted by path switching mechanisms 21 and 22 which are provided at a plurality of diverging points in the sheet transport path 15 and have a plurality of path switching guides, and then the sheet is discharged as it is (or after being sent to a sheet transport path 16 for duplex copying) onto a sheet discharge portion which includes a first discharge tray 17*a* and a second discharge tray 17*b*.

Moreover, a diselectrifying device (unillustrated), which removes residual electrostatic charge from the surface of the photosensitive drum 5, is arranged on the downstream side of a cleaning device 18. Furthermore, the sheet feed mechanism 10 includes a plurality of sheet feed cassettes 10*a* and 10*b* for stacking sheets therein, which are detachably attached to the multifunction peripheral main body 2, and a stack bypass (a manual sheet feed tray) 10*c* disposed above the sheet feed cassettes 10*a* and 10*b*. These are connected via the sheet transport path 11 to the image forming portion 3 which includes the photosensitive drum 5, the developing device 8, etc.

The image reading device 6 is disposed at an upper portion of the multifunction peripheral main body 2. The image reading device 6 has a function of reading image information of a document. To make the image reading device 6 read documents manually placed one by one, a document transport device 27 is opened and documents are placed one by one on a contact glass 6*a* disposed on a top surface of the apparatus main body. To make the image reading device 6 automatically read a batch of documents one by one, the batch of documents are placed on a sheet feed tray 27*a* of the document transport device 27 in a closed state. When a batch of documents are placed on the paper feed tray 27*a*, documents from the batch are automatically sent onto the contact glass 6*a* one by one. In whichever case, a document located on the contact glass 6*a* is irradiated with light from an unillustrated exposure lamp, and light reflected from the document is directed as image light to a photo-electric conversion portion (CCD) via an unillustrated optical system including a reflection mirror, an image forming lens, etc., which are not shown.

The sheet transport path 15 is, specifically, first diverges into two, right and left paths on a downstream side of the fixing roller pair 14*a*. Of the two paths, one path (the rightward path in FIG. 1) is configured to communicate with the first discharge tray 17*a*, and the other path (the leftward path in FIG. 1) further diverges via a transport roller pair 19 into two paths, one of which (the leftward path in FIG. 1) communicates with the second discharge tray 17*b*. On the other hand, the other path (the downward path in FIG. 1) communicates with the sheet transport path 16.

Figure 2:
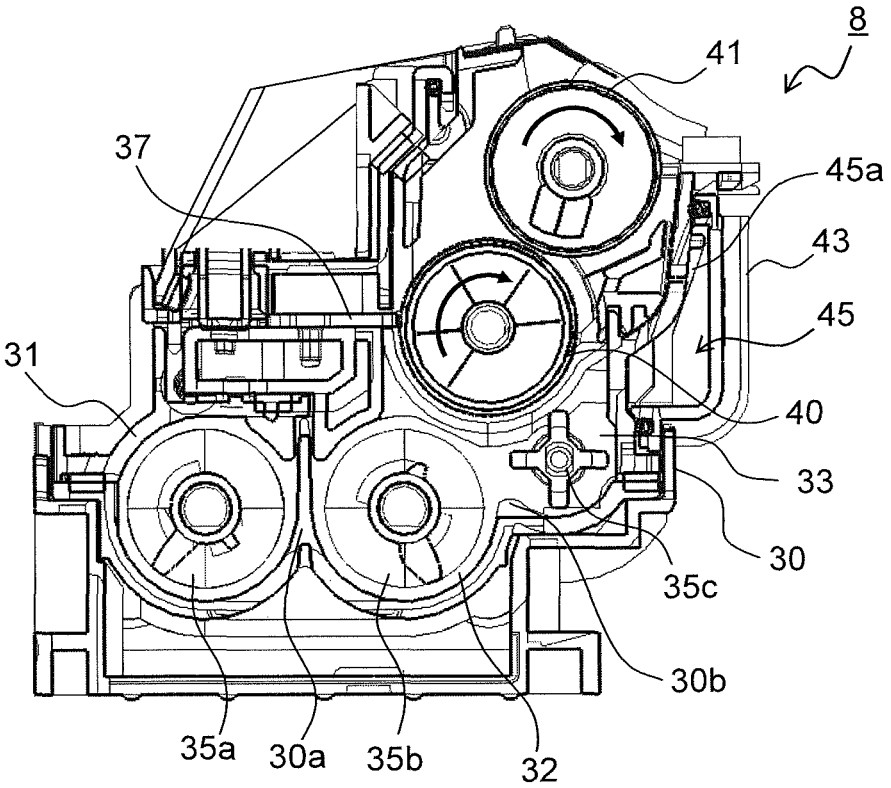
FIG. 2 is a side sectional view of a developing device 8 according to an embodiment of the present disclosure.

FIG. 2 is a side sectional view of the developing device 8 of the present disclosure. Note that FIG. 2 shows the developing device 8 as viewed from the rear surface side of FIG. 1. As shown in FIG. 2, the developing device 8 includes a developing container 30 that holds therein a two-component developer (hereinafter referred to simply as the developer), and the developing container 30 is divided by partition walls 30*a* and 30*b* into a stir transport chamber 31, a supply transport chamber 32, and a collection transport chamber 33. In the stir transport chamber 31 and the supply transport chamber 32, there are rotatably disposed a stir transport screw 35*a* and a supply transport screw 35*b*, respectively, to mix the toner (positive-charge toner) supplied from the toner container 9 (see FIG. 1) with a carrier, and stir the mixture to charge the toner. Moreover, in the collection transport chamber 33, a collection transport screw 35*c* is rotatably disposed to transport the developer removed from a magnetic roller 40.

In the developing container 30, which extends obliquely right upward in FIG. 2, the magnetic roller 40 is disposed above the supply transport screw 35*b*, and a developing roller 41 is disposed obliquely to the upper right of the magnetic roller 40 so as to face the magnetic roller 40. The developing roller 41 faces the photosensitive drum 5 (see FIG. 1) at a side to which the developing container 30 is open (right side in FIG. 2), and the magnetic roller 40 and the developing roller 41 rotate in the clockwise direction in FIG. 2 with respect to their respective rotation shafts.

In the stir transport chamber 31, a toner concentration sensor (unillustrated) is disposed so as to face the first stir transport screw 35*a*, and based on the result of detection by the toner concentration sensor, the toner is replenished from the toner container 9 to the stir transport chamber 31 via a toner replenishment port (unillustrated). Used as the toner concentration sensor is, for example, a magnetic permeability sensor which detects the magnetic permeability of the two-component developer composed of the toner and the magnetic carrier in the developing container 30.

The magnetic roller 40 includes a cylindrical non-magnetic rotation sleeve that rotates in a clockwise direction in FIG. 2, and a fixed magnet body having a plurality of magnetic poles contained within the rotation sleeve. The developing roller 41 includes a cylindrical non-magnetic developing sleeve that rotates in the clockwise direction in FIG. 2, and a developing-roller-side magnetic pole fixed within the developing sleeve. The magnetic roller 40 and the developing roller 41 face each other at a facing position (opposing position) thereof with a predetermined gap therebetween. The developing-roller-side magnetic pole is heteropolar to such one (a main pole) of the magnetic poles of the fixed magnet body as faces the developing-roller-side magnetic pole.

Moreover, a regulating blade 37 is attached to the developing container 30 so as to extend along the longitudinal direction (the direction perpendicular to the sheet surface of FIG. 2) of the magnetic roller 40, and the regulating blade 37 is positioned upstream of the opposing position between the developing roller 41 and the magnetic roller 40 in the rotational direction of the magnetic roller 40 (the clockwise direction in FIG. 2). A small space (gap) is formed between the edge of the regulating blade 37 and the surface of the magnetic roller 40.

A direct current voltage (hereinafter, referred to as "Vslv (DC)") and an alternating current voltage (hereinafter, referred to as "Vslv (AC)") are applied to the developing roller 41, whereas a direct current voltage (hereinafter, referred to as "Vmag (DC)") and an alternating current voltage (hereinafter, referred to as "Vmag (AC)") are applied to the magnetic roller 40. These DC and AC voltages are applied from a developing bias power supply through a bias control circuit (neither are shown) to the developing roller 41 and the magnetic roller 40.

As for the operation of the developing device 8, the developer is transported in the axial direction (the direction perpendicular to the sheet surface of FIG. 2) while being stirred by the stir transport screw 35*a* and the supply transport screw 35*b*. The developer is circulated between the stir transport chamber 31 and the supply transport chamber 32 via developer passages (unillustrated) formed in both ends of the partition wall 30*a*. Thereby, the toner in the developing container 30 is charged and the developer is transported to the magnetic roller 40 by the supply transport screw 35*b*, to form a magnetic brush (unillustrated) on the magnetic roller 40. The thickness of the magnetic brush on the magnetic roller 40 is regulated by the regulating blade 37, and then, the magnetic brush is transported to the opposing portion between the magnetic roller 40 and the developing roller 41, and there, the magnetic brush forms a thin layer of toner on the developing roller 41 by the magnetic field and the difference of potential ΔV between the Vmag (DC) applied to the magnetic roller 40 and the Vslv (DC) applied to the developing roller 41*c*.

The thickness of the toner layer formed on the developing roller 41 depends on factors such as the resistance of the developer and difference in rotational speed between the magnetic roller 40 and the developing roller 41, but the thickness can be controlled by means of ΔV. The toner layer on the developing roller 41 becomes thicker when ΔV increases, and thinner when ΔV decreases. An appropriate range of ΔV during the developing is generally about 100 V to 350 V.

The thin toner layer formed on the developing roller 41 by the magnetic brush is transported by the rotation of the developing roller 41 to an opposing portion between the photosensitive drum 5 and the developing roller 41 where the photosensitive drum 5 and the developing roller 41 face each other. Since Vslv (DC) and Vslv (AC) are applied to the developing roller 41, the toner is caused to fly toward the photosensitive drum 5 by the difference in potential between the photosensitive drum 5 and the developing roller 41, and thereby an electrostatic latent image formed on the photosensitive drum 5 is developed.

The toner remaining without being used for the development is transported back to the opposing portion between the developing roller 41 and the magnetic roller 40, to be collected by the magnetic brush formed on the magnetic roller 40. The magnetic brush is then stripped off from the magnetic roller 40 at a homopolar portion of the fixed magnet body, and thereafter, the magnetic brush falls down into the supply transport chamber 33. The developer within the collection transport chamber 33 is transported in the axial direction by the collection transport screw 35*c*, and joins with the developer existing within the supply transport chamber 32 through a communication portion (unillustrated) formed at one end of the partition wall 30*b*. That is, a circulating passage of the developer is formed, within the developing container 30, with the stir transport chamber 31, the supply transport chamber 32, the collection transport chamber 33, the developer passages, and the communication portion.

Then, based on the result of detection by the toner concentration sensor (unillustrated), a predetermined amount of toner is replenished via the toner replenishment port (unillustrated) to be circulated through the supply transport chamber 32 and the stir transport chamber 31, as a result of which the developer is regenerated as a uniformly charged two-component developer with a proper toner concentration. This developer is supplied back to the magnetic roller 40 by the supply transport screw 35*b* to form a magnetic brush, and is then transported to the regulating blade 37.

A duct cover 43 is attached to an outside of a side wall (the right side wall in FIG. 2) of the developing container 30, and the duct cover 43 and the right side wall of the developing container 30 together form a first duct 45. Moreover, a plurality of air outlet ports 45*a* are provided in the right side wall of the developing container 30 from an opposing portion with respect to the developing roller 41 to communicate with the interior of the first duct 45. The plurality of air outlet ports 45*a* are formed along the longitudinal direction of the developing container 30 (see FIG. 2), such that air around the developing roller 41 within the developing container 30 is discharged through the air outlet ports 45*a* into the first duct 45.

Figure 3:
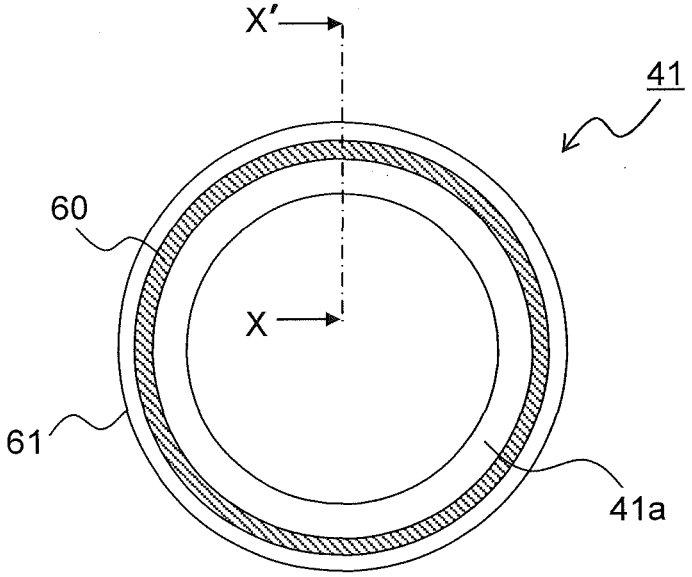
FIG. 3 is a side sectional view of a developing roller 41 used in the developing device 8 of the present disclosure.
Figure 4:
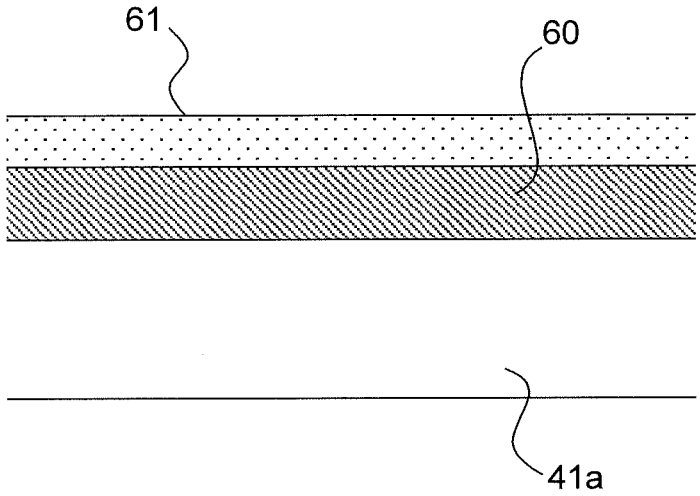
FIG. 4 is an enlarged sectional view of the developing roller 41.

Next, a description will be given of the developing roller 41 used in the developing device 8 of the present disclosure. FIG. 3 is a side sectional view of the developing roller 41, and FIG. 4 is an enlarged sectional view (taken along line XX' and viewed as indicated by arrows in FIG. 4) of the developing roller 41. The developing roller 41 is composed of an aluminum or aluminum-alloy developing sleeve 41*a*, an anodized aluminum layer (anodized aluminum coating film) 60 formed on the outer circumferential surface of the developing sleeve 41*a*, and a coating layer 61 formed on the surface of the anodized aluminum layer 60, the coating layer 61 formed of an alcohol-soluble nylon resin. Note that the developing-roller-side magnetic pole within the developing sleeve 41*a* is not illustrated in FIG. 3 and FIG. 4.

Next, a description will be given of a method for producing the developing roller 41. First, an aluminum or aluminum-alloy cylinder is cut and polished, for example, into a developing sleeve 41*a* having a predetermined outer diameter. Then, the developing sleeve 41*a* is subjected to an anodizing treatment in an acid aqueous solution to thereby form an anodized aluminum layer 60 on the surface of the developing sleeve 41*a*. The anodized aluminum layer 60 is an assembly of a plurality of hexagonal prism cells each having a micropore in the center, and the bottom of the micropore forms an interface (a barrier layer) with respect to the aluminum base. The anodized aluminum layer 60 prevents leakage from being caused when a developing bias is applied to the developing roller 41.

A too large thickness of the anodized aluminum layer 60 increases the resistance of the developing roller 41 as a whole, and it becomes necessary to apply a high-voltage developing bias. On the other hand, with a too small thickness, the anodized aluminum layer 60 cannot be formed as a uniform layer, and this may gives rise to a risk of leakage. Thus, the preferable range of thickness of the anodized aluminum layer 60 is 10 μm to 20 μm.

Thereafter, the surface of the anodized aluminum layer 60 is subjected to heat treatment. This heat treatment is performed for the purpose of making a crack in the anodized aluminum layer 60 before a later-described drying process is performed on the coat layer 61, to thereby prevent generation of cracks in the anodized aluminum layer 60 and the coat layer 61 during the drying process. The heat treatment is determined to be performed for a predetermined time equal to or longer than the time necessary to complete the drying process (for example, 10 minutes or longer, at 120° C.), for example, during which generally a constant amount of cracks are generated with respect to each developing sleeve 41*a*.

After the heat treatment, the coat layer 61 is formed on the surface of the anodized aluminum layer 60. The coat layer 61 reduces the adherence of the toner supplied onto the developing sleeve 41*a* to the anodized aluminum layer 60. Furthermore, the coat layer 61 gives less mechanical stress to the developer than a metal surface would, and this helps achieve compatibility between improvement in performance of toner collection from the developing roller 41 and prevention of degradation of developer, when the amount of developer transported is increased.

Examples of the material of the coat layer 41 include nylon resin, urethane resin, acrylic resin, melamine resin, silicon resin, and fluororesin, among which alcohol-soluble nylon resin is preferable for its similarity in electrostatic property to the resin material of the positive-charge toner and its high toner removability, and also because alcohol-soluble nylon resin allows coating by means of the dipping method, which will be described later.

Here, the coat layer 61 is formed by containing, as a resistance adjusting agent, an electroconductive material of which the dielectric constant is 10 or more, and thereby, the volume resistance value of the coat layer 61 is adjusted and unevenness in resistance is reduced. Examples of the resistance adjusting agent include carbon black, titanium oxide, and fibrous potassium titanate. Thereby, it is possible to stabilize the charged state of the toner layer and improve the removability in toner collection. A preferable range of the volume resistance value of the coat layer 61 is about $10^4$ to $10^8\Omega$, which allows the residual electrostatic charge to properly stay on the surface of the developing roller 41.

In the present disclosure, the coat layer 61 is formed by means of a dipping method. Specifically, the developing sleeve 41*a*, on which the anodized aluminum layer 60 has been formed, is dipped into a coating liquid with one end thereof first, the one end being a lower end of during the dipping, and is then lifted out of the coating liquid with the other end thereof first. Then, the developing sleeve 41*a* coated with the coating liquid is subjected to a drying process performed at a predetermined temperature for a predetermined time (for 10 minutes at 130° C., for example), as a result of which the coat layer 61 is formed with a thickness of about 2 to 11 μm.

Figure 5:
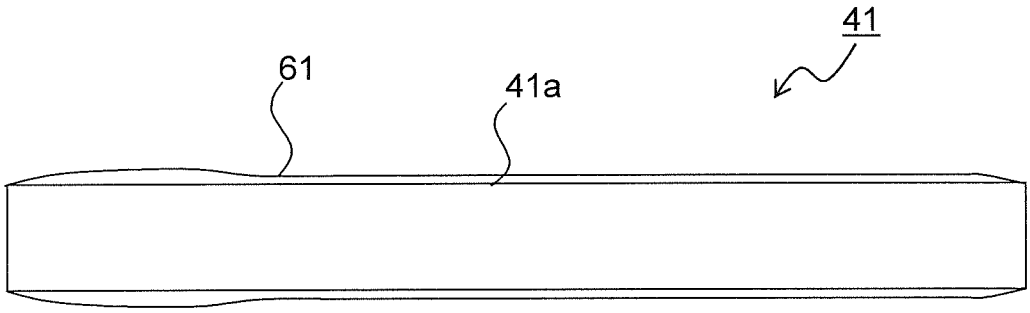
FIG. 5 is a longitudinal sectional view showing a thickness of a coat layer 61 formed on a developing sleeve 25*a* by means of a dipping method.

When the coat layer 61 of the developing roller 41 is formed by means of the above-described dipping method, the coat layer 61 tends to be thicker at the lower end of during the dipping (the left end in FIG. 5) than in the center portion in the longitudinal direction of the developing roller 41 as shown in FIG. 5.

Figure 6:
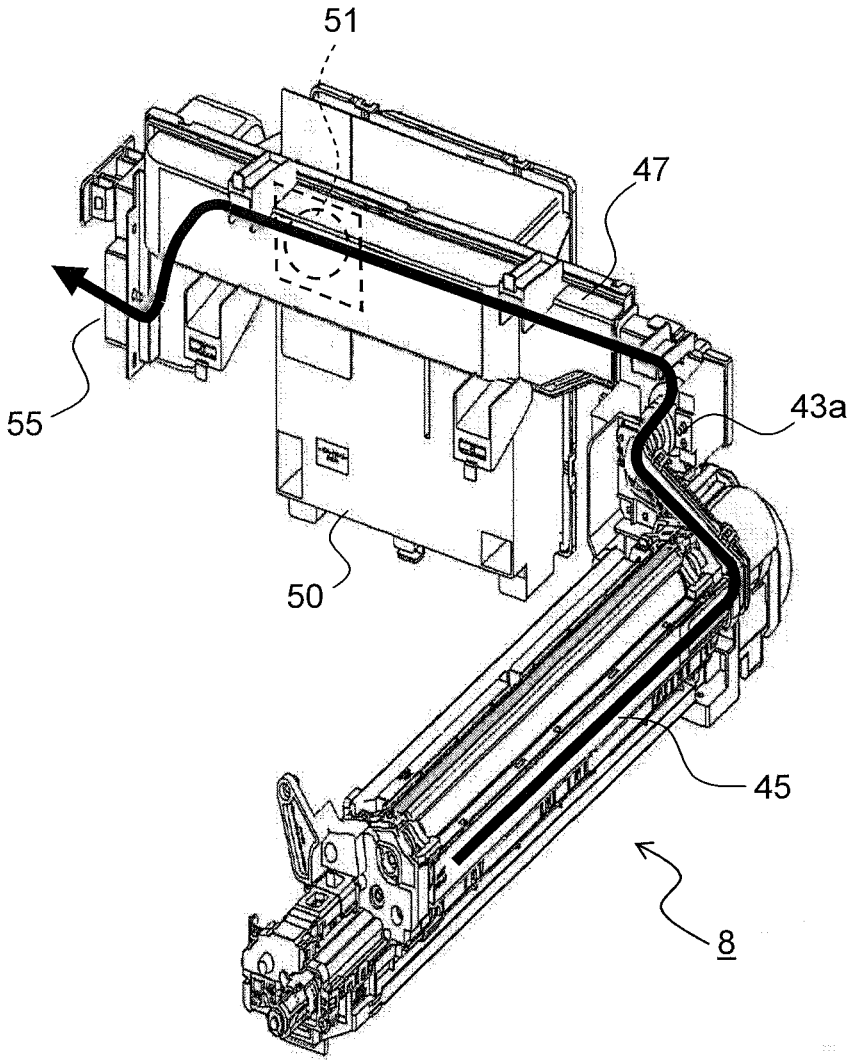
FIG. 6 is a perspective view showing an air passage from the developing device 8 to a waste collector 50.
Figure 7:
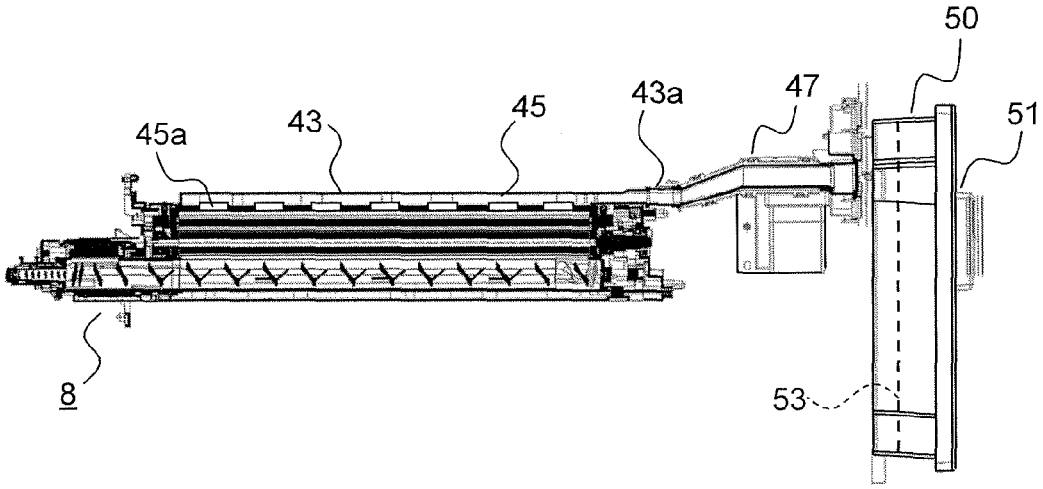
FIG. 7 is a sectional view showing the air passage from the developing device 8 to the waste collector 50.

FIG. 6 is a perspective view showing an air passage from the developing device 8 to a waste collector 50, and FIG. 7 is a sectional view showing the air passage from the developing device 8 to the waste collector 50. At one end of the duct cover 43, which is disposed on a lateral side of the developing device 8, a linking portion 43*a* is formed. By connecting the duct cover 43 and a second duct 47 via the linking portion 43*a*, the first duct 45 is connected to the waste collector 50 via the second duct 47.

An exhaust fan 51 is disposed in the waste collector 50, and a filter 53 is provided between the exhaust fan 51 and the second duct 47. When the exhaust fan 51 is operated, airflow is generated to flow at a predetermined flow rate in the first duct 45 and the second duct 47, and thereby, toner particles floating inside the developing container 30 are sucked out of the developing container 30 into the first duct 45 through the air outlet ports 45*a*. The toner particles sucked into the first duct 45 pass through the second duct 47, to be caught by the filter 53. The air from which the toner particles have been removed by the filter 53 is discharged to the outside of the image forming apparatus 100 through an exhaust port 55.

In the configuration as has been described above, during the suction of air around the developing roller 41 together with the floating toner particles into the first duct 45, since the developing device 8 has an elongated shape, difference is caused in the flow rate of the airflow directed from the air outlet ports 45*a* to the first duct 45 in the longitudinal direction (the right-left direction of FIG. 7) of the developing container 30. Specifically, the flow rate of the airflow is high at an end portion of the developing container 30 on the linking portion 43*a* side (right side in FIG. 7), which is an end portion that is close to the exhaust fan 51, and the flow rate of the airflow is low at another end portion on the opposite side (left side in FIG. 7).

Thus, when the flow rate of the airflow directed from the air outlet ports 45*a* to the first duct 45 is adjusted to an appropriate flow rate on the linking portion 43*a* side, the flow rate is not high enough at the end portion on the opposite side (left side in FIG. 7). In the portion where the flow rate is not high enough, it is impossible to satisfactorily suck out floating toner particles, which leads to risks of leakage of the floating toner particles through the opening of the developing container 30 and dropping toner caused by the floating toner particles forming lumps to fall down onto the developing roller 41. On the other hand, when the flow rate of the airflow is adjusted to an appropriate flow rate on the side where the flow rate is not high enough (left side in FIG. 7), the flow rate becomes too high on the linking portion 43*a* side. At the portion where the flow rate is too high, the toner particles floating inside the developing container 30 are sucked into the first duct 45 to excess, which causes the first duct 45 and the filter 53 to be more prone to clogging.

Figure 8:
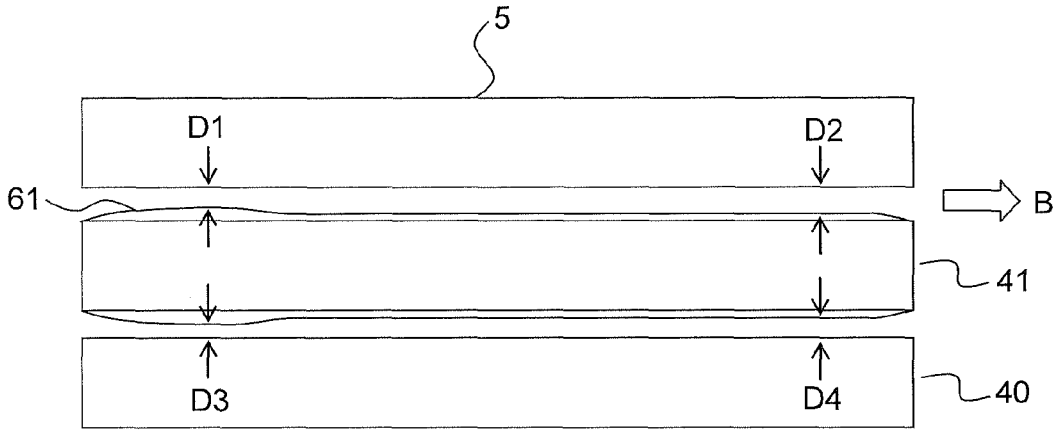
FIG. 8 is a diagram showing a relationship between the arrangement of the developing roller 41 and the direction of an airflow generated by an exhaust fan 51.

With this in mind, in the present disclosure, as shown in FIG. 8, the developing roller 41 is disposed such that the lower end (the left end in FIG. 5) during the dipping of the dipping method by means of which the coat layer 61 has been formed thereon is located on the upstream side (the left side in FIG. 8) with respect to the direction (direction indicated by arrow B) of airflow generated by the exhaust fan 51. That is, the direction of the developing roller 41 is determined such that the coat layer 61 has a large thickness on the side where the flow rate of the airflow directed to the first duct 45 is low.

With this arrangement, gap D1 between the photosensitive drum 5 and the developing roller 41 (hereinafter referred to as "between D and S") on the side where the flow rate of the airflow is low (left end in FIG. 8) is narrower than gap D2 between D and S on the side where the flow rate of the airflow is high, by the amount of difference in the thickness of the coat layer 61.

Moreover, gap D3 between the magnetic roller 40 and the developing roller 41 (hereinafter referred to as "between M and 5") on the side where the flow rate of the air flow is low (left end in FIG. 8) is narrower than gap D4 between M and S on the side where the flow rate of the airflow is high (right side in FIG. 8), by the amount of difference in the thickness of the coat layer 61.

The difference between D1 and D2 serves to offset the difference in the flow rate, and thus the flow rate of the airflow flowing in the first duct 45 becomes substantially uniform over the whole area in the longitudinal direction of the first duct 45, and the difference in the flow rate of the airflow in the longitudinal direction of the first duct 45 is dissolved.

Furthermore, on the side where the flow rate is low, the narrow gap between M and S makes it easier for scattered toner, which is caused when toner on the developing roller 41 is collected by the magnetic brush formed on the magnetic roller 40, to go back to the magnetic roller 40. This makes it possible to reduce the generation of scattered toner compared with on the side of the high flow rate.

Thus, on the side where the flow rate of the airflow directed to the first duct 45 is low, it is possible to reduce the leakage of toner through the opening of the developing container 30 caused by the low flow rate. Moreover, on the side where the flow rate of the airflow directed to the first duct 45 is high, it is possible to prevent suction of too much toner into the first duct 45 caused by the excessively high flow rate.

Figure 9:
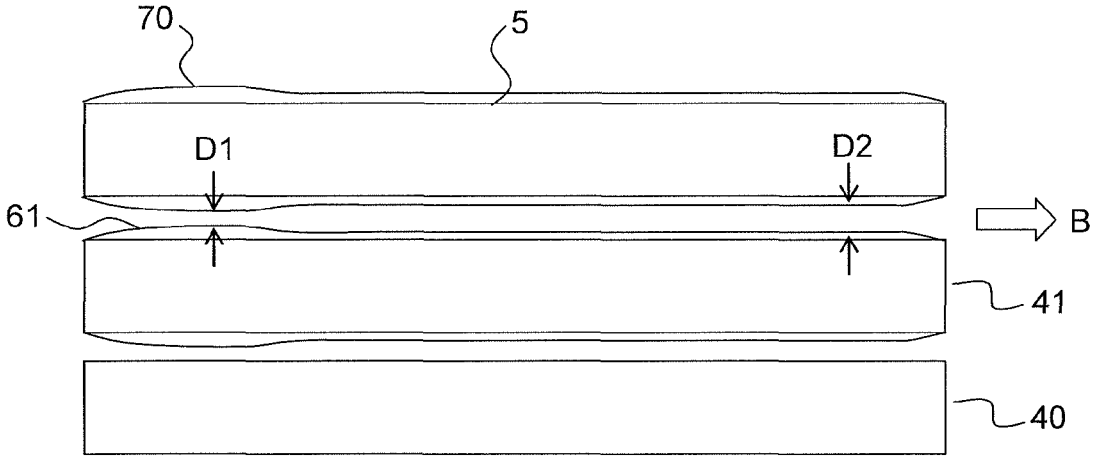
FIG. 9 is a diagram showing an arrangement of a photosensitive drum 5 and the developing roller 41 in a case where the photosensitive drum 5 is an OPC photosensitive body on which an organic photosensitive layer (OPC) is formed by a dipping method.

FIG. 9 is a diagram showing an arrangement of the photosensitive drum 5 and the developing roller 41 in a case where the photosensitive drum 5 is an OPC photosensitive body where an organic photosensitive layer (OPC) is formed by means of a dipping method. To form a photosensitive layer 70 by means of the dipping method, an aluminum drum base tube is dipped into a photosensitive liquid with one end thereof first, the one end being a lower end of during the dipping, and lifted out of the photosensitive liquid with the other end thereof first, and then, the photosensitive layer is dried and hardened. Thus, like in the case of forming the coat layer 61 on the developing roller 41, the thickness of the photosensitive layer 70 tends to be thicker on the lower end of during the dipping (left end in FIG. 9) than at a center portion thereof in the longitudinal direction of the photosensitive drum 5.

With this in mind, the photosensitive drum 5 is arranged such that its end portion (left end in FIG. 9) that has been the lower end of during the dipping of the dipping method by means of which the photosensitive layer 70 has been formed thereon is located on the upstream side (left side in FIG. 9) with respect to the direction (direction indicated by arrow B) of airflow generated by the exhaust fan 51. With this arrangement, gap D1 between the photosensitive drum 5 and the developing roller 41 (hereinafter referred to as "between D and S") on the side where the flow rate of the airflow is low (left end in FIG. 9) is narrower than gap D2 between D and S at the side where the flow rate of the airflow is high (right end in FIG. 9), by the amount corresponding to the sum of the difference in the thickness of the coat layer 61 and the difference in the thickness of the photosensitive layer 70. This makes it possible to offset the difference in the flow rate of the airflow in the longitudinal direction of the first duct 45 even more effectively.

It should be understood that the present disclosure is not limited to the above embodiments, and various modifications are possible within the scope of the present disclosure. For example, the shapes, sizes, and other features of the first duct 45 and the second duct 47 are appropriately settable in accordance with the amount of toner particles floating in the developing container 30, the shape condition of the air passage, the output of the exhaust fan 51, and other factors, and these features are not particularly limited.

Moreover, the present disclosure is applicable, not only to developing devices like the one shown in FIG. 2 which is provided with the magnetic roller 40 that carries a two-component developer and the developing roller 41 that carries only a toner, but also to developing devices employing a two-component developing system where an electrostatic latent image on a photosensitive drum is developed by using a magnetic brush formed on a developing roller 41, without using a magnetic roller 40, and to developing devices employing a one-component developing system where after being carried on a developing roller by a magnetic carrying force, a magnetic one-component developer (toner) in a developing container is caused to fly to a photosensitive drum at a developing position. Furthermore, the developing device can be incorporated, not only in monochrome multifunction peripherals like the one shown in FIG. 1, but also in other types of image forming apparatuses such as monochrome printers, tandem color printers, color multifunction peripherals, and facsimiles. Hereinafter, the effects of the present disclosure will be described more specifically by using examples of the present disclosure.

EXAMPLE 1

Making of Developing Roller

Anodizing treatment was performed to the outer circumferential surface of a developing sleeve 25*a* made of an aluminum base tube having a diameter of 20 mm, to form an anodized aluminum layer 60 having a thickness of 10 μm, and then the surface of the anodized aluminum layer 60 was subjected to heat treatment at 120° C., for longer than 10 minutes. On the other hand, a coating liquid was prepared by mixing and dispersing the following materials using a ball mill (with zirconia beads having a diameter of 1 mm) for 48 hours: 100 parts by weight of an alcohol-soluble nylon resin (CM8000, a product of Toray Industries Inc.) as a binding resin; 100 parts by weight of a titanium oxide (ET-300W, a product of Ishihara Sangyo Kaisha, Ltd.) as an electroconductive material; and 800 parts by weight of methanol as a dispersion medium. Subsequently, the anodized developing sleeve 25*a* was dipped (soaked) into the coating liquid with one end thereof first, the one end being a lower end of during the dipping, and then pulled out of the coating liquid with the other end thereof first, with the axial direction of the cylindrical shape thereof kept parallel to the vertical direction all the while. Thereafter, the anodized developing sleeve 25*a* was dried at 130° C. for 10 minutes. Thereby, a coat layer 61 having a thickness of about 2 to 11 μm was formed on the surface of the anodized layer 60.

EXAMPLE 2

Evaluation of Flow Rate of Airflow in First Duct

The developing device 8 of the present disclosure was fabricated in which the developing roller 41 produced in Example 1 was installed such that the lower end of during the dipping was located on the upstream side of the first duct 45. Moreover, as a comparative example, another developing device 8 was fabricated in which was installed another developing roller 41 provided with a developing sleeve 25*a* having a coat layer 61 formed on an anodized layer 40 by spray coating (the thickness of the coat layer 61 is substantially uniform in the longitudinal direction). These developing devices 8 were each mounted in the testing apparatus shown in FIG. 1, and the flow rate of airflow caused in the first duct 45 when the exhaust fan 51 was operated was measured at a plurality of points (14 points) between the upstream side (suction far side) and the downstream side (suction near side) with respect to the airflow direction. The measurement results are shown in FIG. 10.

Figure 10:
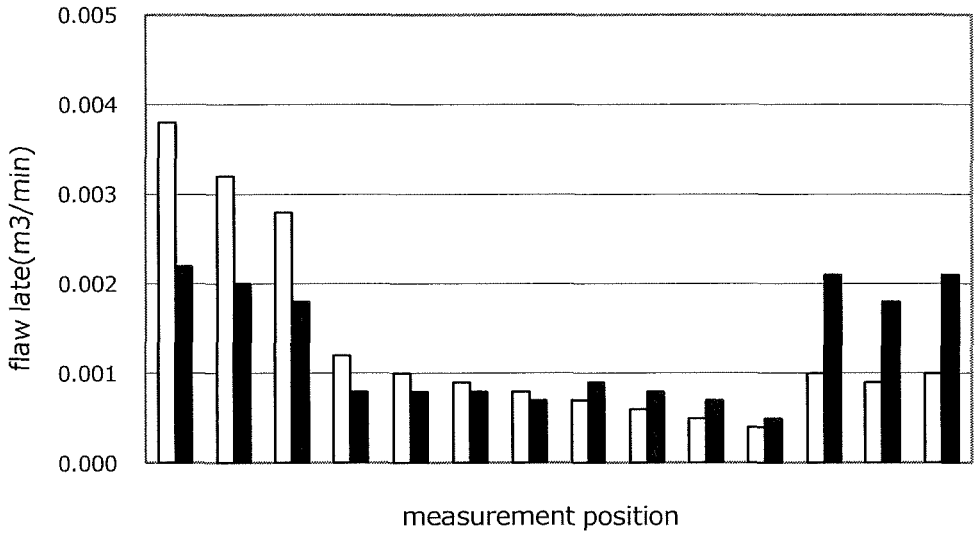
FIG. 10 is a graph showing results of measurements conducted to measure the flow rate of airflow in a first duct 45 at a plurality of points from an upstream side (suction far side) to a downstream side (suction near side) with respect to the airflow direction in Example 2.

As is clear from FIG. 10, in the case with the developing device 8 of the present disclosure in which the lower end of during the dipping of the developing sleeve 25*a* was located on the upstream side with respect to the airflow direction in the first duct 45, the difference in the flow rate of the airflow between on the suction near side, at the center portion, and on the suction far side was reduced, as compared with the case with the developing device 8 of the comparative example using the developing sleeve 25*a* having the coat layer 41 formed by spray coating.

EXAMPLE 3

Evaluation of Toner Clogging at Linking Portion of First Duct

By mounting the developing device 8 of the present disclosure and that of the comparative example each in the testing apparatus shown in FIG. 1, the flow rate of the airflow at the linking portion 43*a* between the first duct 45 and the second duct 47 was measured each time printing had been performed with respect to a predetermined number of sheets during continuous printing of a test image. The measurement results are shown in FIG. 11.

Figure 11:
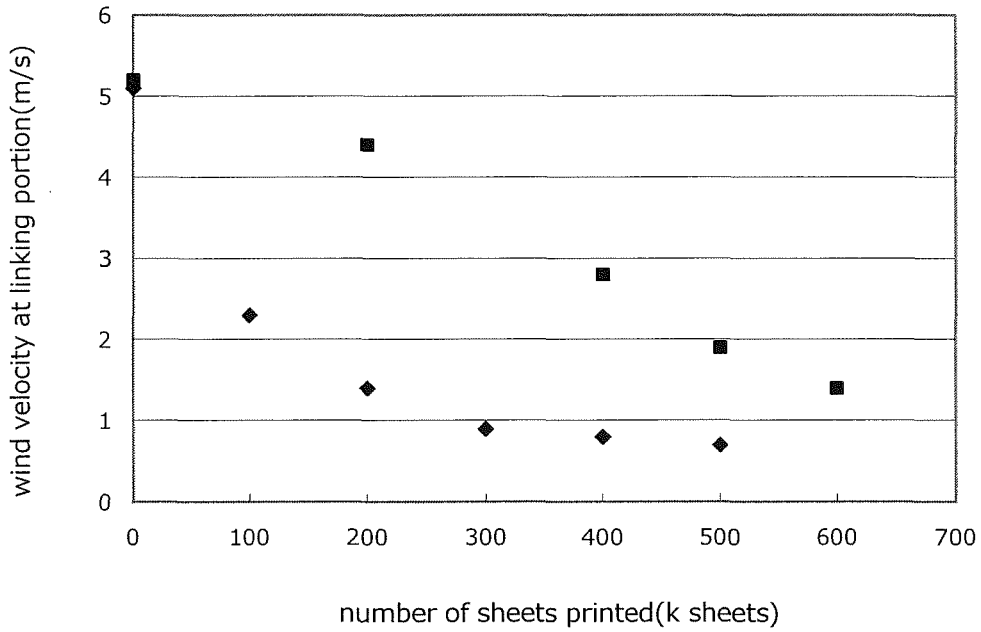
FIG. 11 is a graph showing results of measurements conducted to measure the flow rate of airflow at a linking portion 43*a* each time a test image was printed on a predetermined number of sheets during continuous printing of the test image.

As is clear from FIG. 11, the initial flow rate of the airflow was higher and the flow rate decreased more slowly after printing on predetermined number of sheets in the case with the developing device 8 of the present disclosure in which the end portion of the developing sleeve 25*a* that had been on the lower end side at the time of the dipping was located on the upstream side with respect to the airflow direction in the first duct 45 (data series indicated by ■ in FIG. 11 than in the case with the developing device 8 of the comparative example using the developing sleeve 25*a* having the coat layer 41 formed thereon by spray coating (data series indicated by ◆ in FIG. 11). These results have confirmed that toner clogging at the linking portion 43*a* is reduced more effectively in the developing device 8 of the present disclosure than in the developing device 8 of the comparative example.

The descriptions herein have been focused on the effects when the present disclosure is applied to a developing device 8 of a non-contact developing system where only toner is moved from a magnetic roller to a developing roller, from which the toner is made to fly to a photosensitive drum. However, the same effects have been confirmed in the case where the present disclosure is applied to a developing device that does not use a magnetic roller and develops an electrostatic latent image formed on a photosensitive drum by using a magnetic brush formed on a developing roller.

The present disclosure can be used in developing devices that supply toer to an image carrier by using a toner carrier. Through the use of the present disclosure, it is possible to provide a developing device and an image forming apparatus where the air suction force is uniformed in the longitudinal direction of a developing container to thereby effectively prevent leakage of toner from the developing device and accumulation of toner in the vicinity of a regulating blade.

What is claimed is:

1. A developing device comprising:

a developing container configured to hold therein a developer containing a toner;

a toner carrier having part of an outer circumferential surface thereof exposed through an opening in the developing container, whereby the toner carrier is arranged so as to face an image carrier, the toner carrier being configured to supply toner to the image carrier; and a plurality of air outlet ports formed in such part of a wall of the developing container as faces the toner carrier, along a longitudinal direction of the developing container, the plurality of air outlet ports communicating with an interior of a duct, the toner carrier having a coat layer formed on an outer circumferential surface thereof by means of a dipping method of dipping the toner carrier into a resin coating liquid with one end of the toner carrier in a longitudinal direction thereof first, the one end being a lower end of during the dipping, and then lifting the toner carrier out of the resin coating liquid with another end of the toner carrier in the longitudinal direction thereof first, the toner carrier being arranged such that the lower end of during the dipping is disposed on an upstream side with respect to an airflow direction in the duct, wherein a gap between the image carrier and the toner carrier is narrower on an upstream side with respect to the airflow direction in the duct than on a downstream side with respect to the airflow direction in the duct.

2. The developing device according to claim 1, wherein the developer is a two-component developer containing a magnetic carrier and a toner, the developing device further comprises a developer carrier disposed to face the toner carrier and configured to form a toner layer on the toner carrier by using a magnetic brush of the two-component developer formed on a surface of the developer carrier, and the plurality of air outlet ports are formed in such part of the wall of the developing container as is close to an opposing portion between the toner carrier and the developer carrier.

3. An image forming apparatus comprising:

the developing device according to claim 1;

the image carrier disposed to face the toner carrier and having a photosensitive layer formed on an outer circumferential surface thereof;

the duct communicating with the plurality of air outlet ports provided in the developing device;

an exhausting device configured to generate airflow in the duct to exhaust air in the developing container to outside a main body of the image forming apparatus; and a filter disposed on an airflow exhausting side of the duct and configured to capture toner that has passed through the duct together with the air exhausted from inside the developing container.

4. The image forming apparatus according to claim 3, wherein the image carrier is a photosensitive drum including: a drum base tube that is cylindrical; and an organic photosensitive layer formed on an outer circumferential surface of the drum base tube by a dipping method of dipping the drum base tube into a photosensitive liquid with one end of the drum base tube in a longitudinal direction thereof first, the one end being a lower end of during the dipping, and then lifting the drum base tube out of the photosensitive liquid with another end thereof in the longitudinal direction thereof first, and the photosensitive drum is arranged such that the lower end of during the dipping is disposed on the upstream side with respect to the airflow direction in the duct.

5. A developing device comprising:

a developing container configured to hold therein a developer containing a toner;

a toner carrier having part of an outer circumferential surface thereof exposed through an opening in the developing container, whereby the toner carrier is arranged so as to face an image carrier, the toner carrier being configured to supply toner to the image carrier and a plurality of air outlet ports formed in such part of a wall of the developing container as faces the toner carrier, along a longitudinal direction of the developing container, the plurality of air outlet ports communicating with an interior of a duct, the toner carrier having a coat layer formed on an outer circumferential surface thereof by means of a dipping method of dipping the toner carrier into a resin coating liquid with one end of the toner carrier in a longitudinal direction thereof first, the one end being a lower end of during the dipping, and then lifting the toner carrier out of the resin coating liquid with another end of the toner carrier in the longitudinal direction thereof first, the toner carrier being arranged such that the lower end of during the dipping is disposed on an upstream side with respect to an airflow direction in the duct, wherein the developer is a two-component developer containing a magnetic carrier and a toner, the developing device further comprises a developer carrier disposed to face the toner carrier and configured to form a toner layer on the toner carrier by using a magnetic brush of the two-component developer formed on a surface of the developer carrier, the plurality of air outlet ports are formed in such part of the wall of the developing container as is close to an opposing portion between the toner carrier and the developer carrier, and a gap between the developer carrier and the toner carrier is narrower on an upstream side with respect to the airflow direction in the duct than on a downstream side with respect to the airflow direction in the duct.

6. An image forming apparatus comprising:

the developing device according to claim 5;

the image carrier disposed to face the toner carrier and having a photosensitive layer formed on an outer circumferential surface thereof;

the duct communicating with the plurality of air outlet ports provided in the developing device;

an exhausting device configured to generate airflow in the duct to exhaust air in the developing container to outside a main body of the image forming apparatus; and a filter disposed on an airflow exhausting side of the duct and configured to capture toner that has passed through the duct together with the air exhausted from inside the developing container.

7. The image forming apparatus according to claim 6, wherein the image carrier is a photosensitive drum including: a drum base tube that is cylindrical; and an organic photosensitive layer formed on an outer circumferential surface of the drum base tube by a dipping method of dipping the drum base tube into a photosensitive liquid with one end of the drum base tube in a longitudinal direction thereof first, the one end being a lower end of during the dipping, and then lifting the drum base tube out of the photosensitive liquid with another end thereof in the longitudinal direction thereof first, and the photosensitive drum is arranged such that the lower end of during the dipping is disposed on the upstream side with respect to the airflow direction in the duct.

* * * * *